US005960990A

United States Patent [19]

Radosevich

[11] Patent Number: 5,960,990

[45] Date of Patent: Oct. 5, 1999

[54] PRODUCT DISCHARGE ACTIVATOR AND METHOD OF USE

[76] Inventor: Paul T. Radosevich, 15129 Park Dr., Dayton, Minn. 55327

[21] Appl. No.: 08/927,547

[22] Filed: Sep. 6, 1997

[51] Int. Cl.[6] ..... B67B 7/00; A45D 24/22

[52] U.S. Cl. ..... 222/1; 222/199; 222/333

[58] Field of Search ..... 222/1, 199, 200, 222/333, 203

[56] References Cited

U.S. PATENT DOCUMENTS

| | | | |
|---|---|---|---|
| 3,971,493 | 7/1976 | Williams | 222/199 X |
| 4,545,509 | 10/1985 | Musschoot et al. | 222/199 X |
| 4,721,231 | 1/1988 | Richter | 222/199 X |

FOREIGN PATENT DOCUMENTS

| | | | |
|---|---|---|---|
| 130255 | 1/1985 | European Pat. Off. | 222/199 |

OTHER PUBLICATIONS

Vibra Screw, Inc. brochure The Bin Activator, Metalfab, Inc. brochure Metalfab Bin Activators, 1994.

Martin Engineering brochure Motomagnetic Rotary Electric Vibrators.

*Primary Examiner*—Gregory L. Huson

*Attorney, Agent, or Firm*—Angenehm Law Firm, Ltd.; N. Paul Friederichs

[57] ABSTRACT

A flowable bulk product discharge activator and method of discharging flowable bulk products assures uniform, mass-flow discharge of loose, dry, flowable, bulk products from bulk storage containers that is void of any internal horizontal ledges to interrupt downward flow, while including sanitary features that impart a sifting/activating action to the flowable products discharging from the container. The product discharge activator has knife-sharpened and angled supports, a baffle, vertically oriented sifting plates all disposed in a vibratable chamber, the chamber joined to a vibrating motor.

16 Claims, 5 Drawing Sheets

PRODUCT DISCHARGE ACTIVATOR AND METHOD OF USE

FIELD OF THE INVENTION

The present invention relates to the storage of loose, dry, bulk, flowable products that are handled in large volumes as a practical means of stockpiling or supplying raw materials for use in production-scale processing or manufacturing in a wide variety of uses or for a wide variety of end products. More specifically, this invention pertains to the discharge of bulk flowable products from storage containers in a uniform, mass-flow manner that is sanitary, efficient and that accomplishes a first-in/first-out discharge of the contained product.

BACKGROUND OF THE INVENTION

Large volumes of flowable bulk products, generally in the form of flowable grains, powders, granules, flakes, chips, fibers, pellets, flour or the like may commonly be stored in containers including, for example, hoppers, bins, storage silos, railroad cars bulk container trucks and the like. Such containers are used as a convenient means to compile and draw from the flowable bulk product during production, processing, transporting, or for use in the production of other goods.

Flowable bulk product can typically be deposited or loaded into such containers through an inlet at the top, and then typically be withdrawn or discharged by shape gravity mechanism from the container through an outlet at the bottom. The types of flowable bulk products stored in such situations typically exhibit a wide variation of specific product characteristics including: particle size, size distribution, shape, product bulk density, moisture content, cohesiveness, etc. Flowable products in bulk storage containers are also recognized to exert compacting forces on lower portions of the product within the container, due to the weight of the product above pressing downward. The specific product characteristics, in combination with these compacting forces, may oftentimes cause the flowable product to dam or bridge in lower portions of the container, restricting or obstructing desired simple gravity flow discharge of the product at the container outlet. One example of a flowable bulk product that exhibits such restrictive flow phenomena is flour, such as wheat flour, when stored in bulk containers.

Various types of mechanical discharge devices have previously been used to aid in the task of discharging flowable bulk products from storage containers. One device is referred to as a Vibratory Bin Discharger, which utilizes a vibratory motor activated hopper with flexible connections and an internal baffle. The internal baffle is typically supported by components such as square tubing or pipe that are positioned horizontally and fastened to inside walls of the hopper.

This method of support results in several disadvantages. The horizontal components introduce obstacles which the downward flow of product must avoid. Such horizontal or generally horizontal obstacles interfere with the true mass-flow product discharge and provide surfaces or ledges on which product will remain lodged. When such blockage occurs within flowable bulk product intended for human or animal consumption, unsanitary conditions within the stored product become a serious concern. Portions of older product that remain in the container longer than the recommended safe storage life, lead to initiation and spread of contamination. While the previous Vibratory Bin Discharger system helps solve some problems in the discharge of loose flowable products from bulk storage, there still is a need for a less restrictive and more effective discharge activator.

SUMMARY OF THE INVENTION

The present invention is a flowable bulk product discharge activator which discharges loose, dry, flowable product from bulk storage containers, such as hoppers, bins, silos, or the like, in a sanitary, uniform, mass-flow manner. The flowable product discharge activator of this invention includes four major components, in addition to a conventional bulk storage container: a hopper portion, a vibratory motor, an internal baffle and strut support members.

The hopper portion is suspended from the inlet flange by the limited free-swinging, hanging fasteners and is flexibly connected at its top and bottom to the container to allow limited free swinging, easily vibratable movement of the hopper portion. The inlet flange is bolted to the flanged outlet of the bulk storage container.

The hopper portion may generally be a cone or pyramid shaped shell, with its apex or minimal cross-sectional end oriented downward, having in-flow and out-flow openings at upper and lower ends thereof, respectively. The vibratory motor is operatively connected to the hopper portion so as to impart a rapid, circular motion to the product flowing through the hopper portion. The vibratory motor shakes or agitates the flexibly supported hopper portion and the flowable bulk product passing therethrough. The internal baffle is positioned within the hopper portion with its apex or minimal cross-sectional end oriented upward, so that the baffle and the hopper have a common vertical axis. The baffle shields the flowing product from compacting forces exerted on the product near the hopper outlet. The baffle is supported by strut members within the hopper. The strut members include sifting/activating features which further provide activation of the flowing product near the hopper outlet. The upper edges of the strut members and the sifting/activating features are tapered and honed to a knife-edge, thus avoiding obstacles or surfaces upon which flowing product could become lodged.

DETAILED DESCRIPTION

Figure 1:
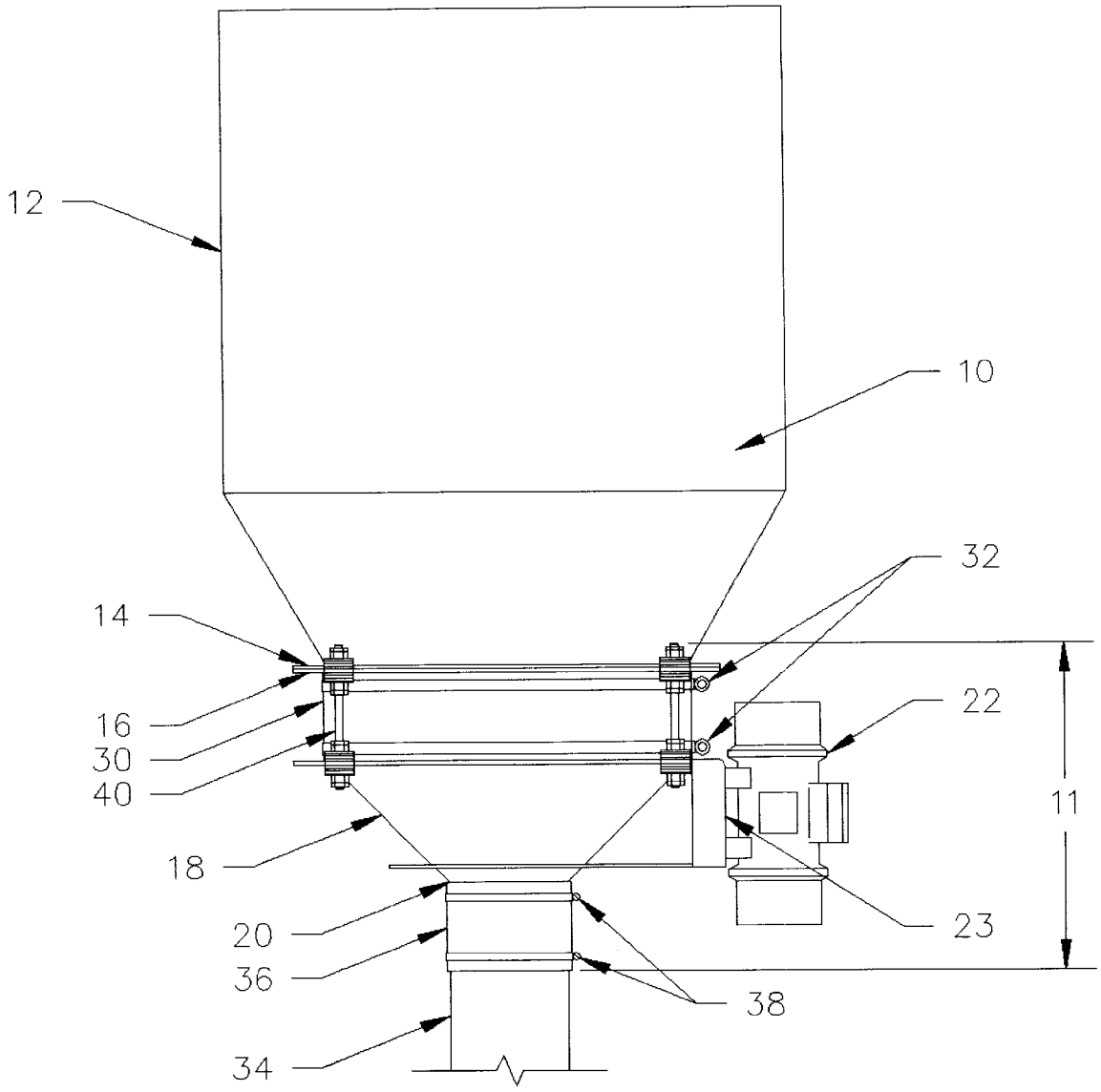
FIG. 1 is a prospective view of the flowable product discharge activator of the present invention positioned in connection with a bulk storage container.
Figure 2:
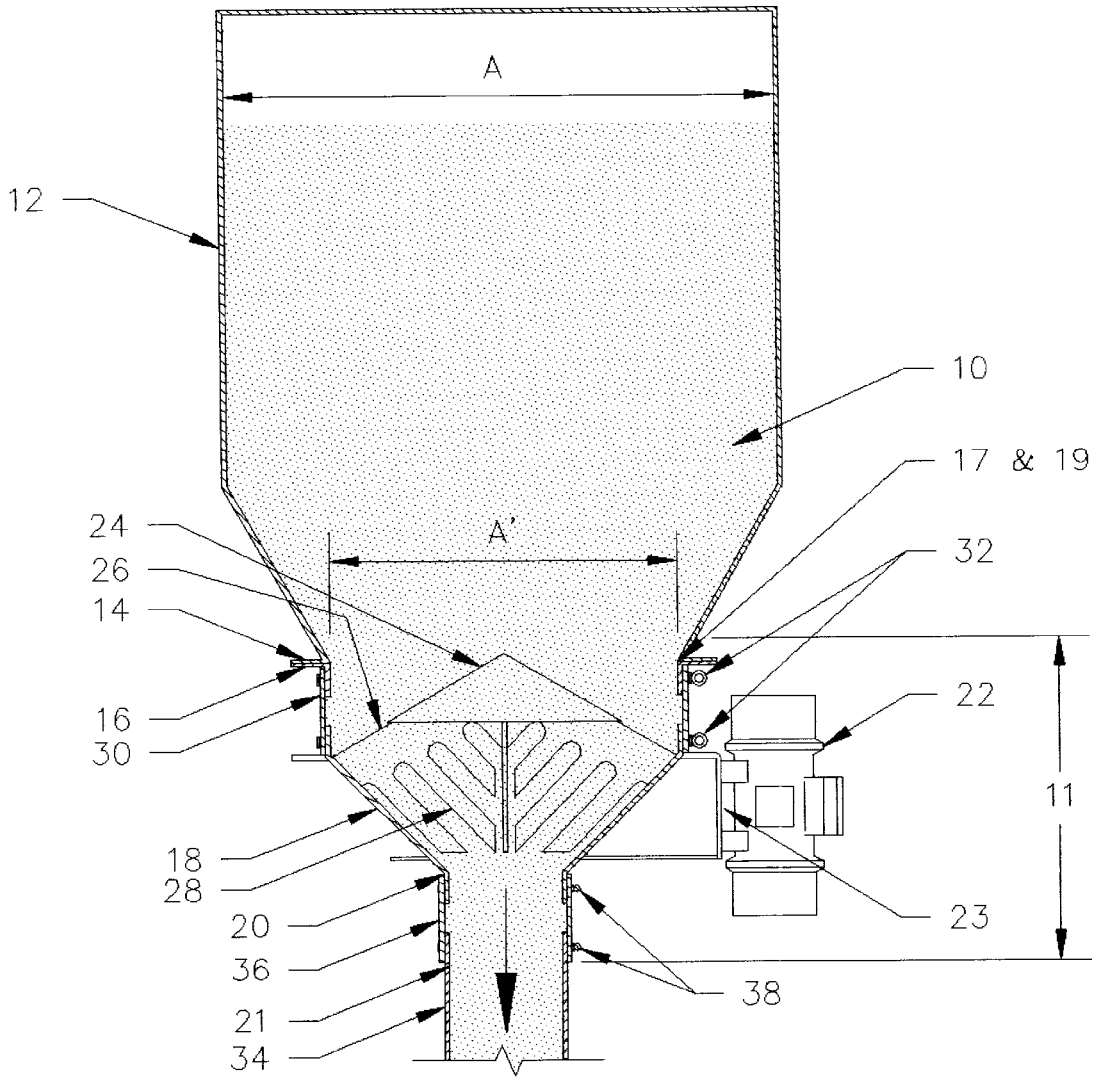
FIG. 2 is a cross-sectional view of the activator revealing the internal construction of the activator and the contained product.
Figure 3:
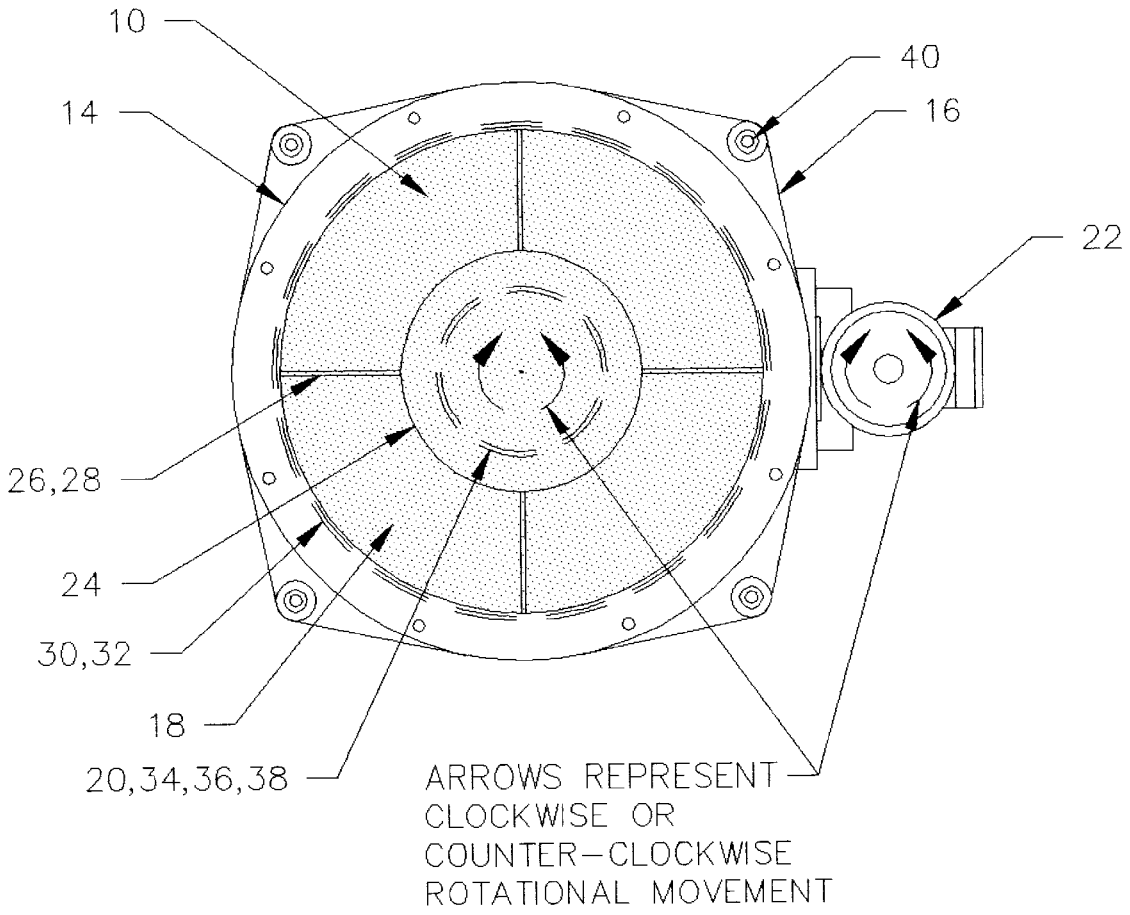
FIG. 3 shows a top plan view of the activator, illustrating the circular action of the apparatus in operation.
Figure 4:
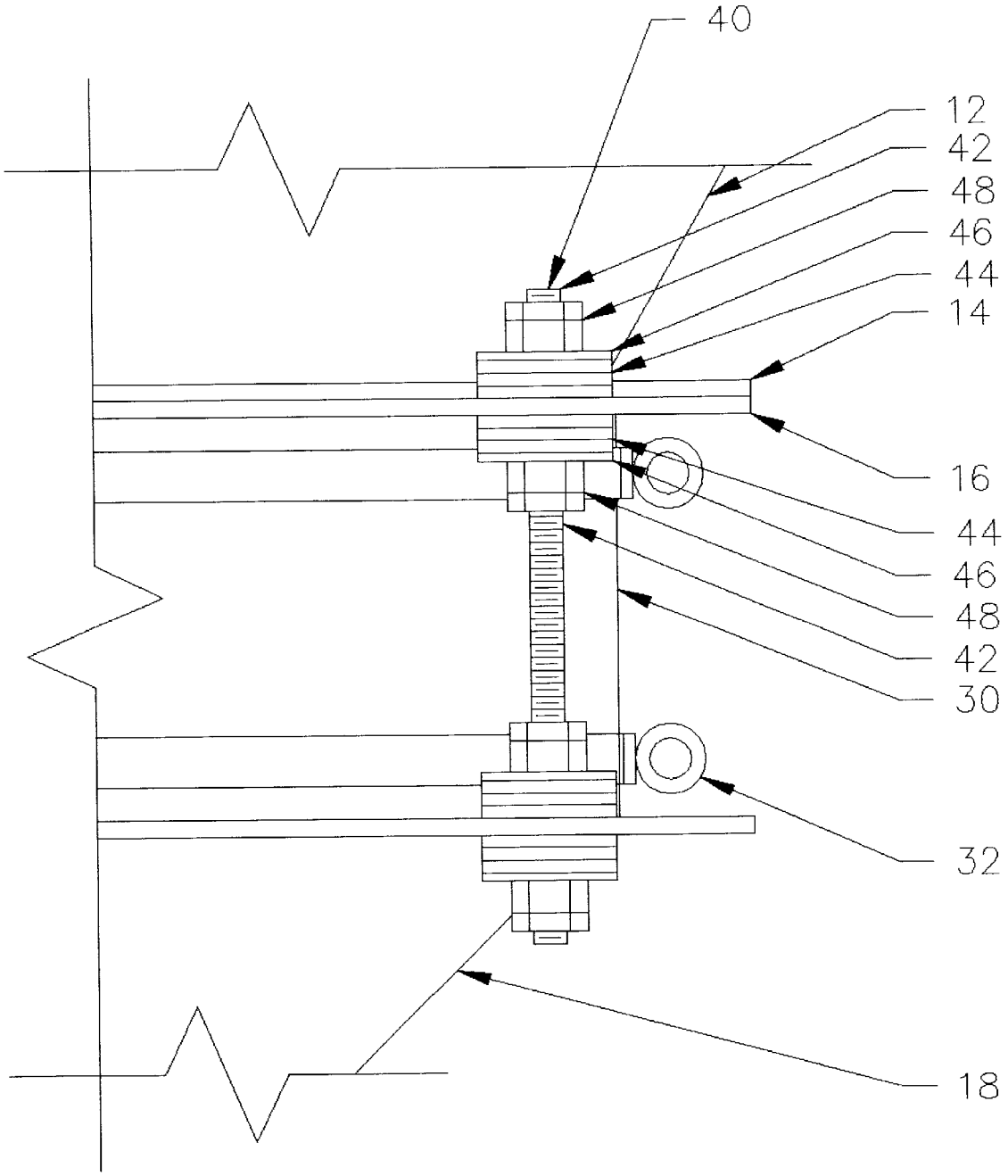
FIG. 4 shows a prospective view of a hanging fastener.
Figure 5:
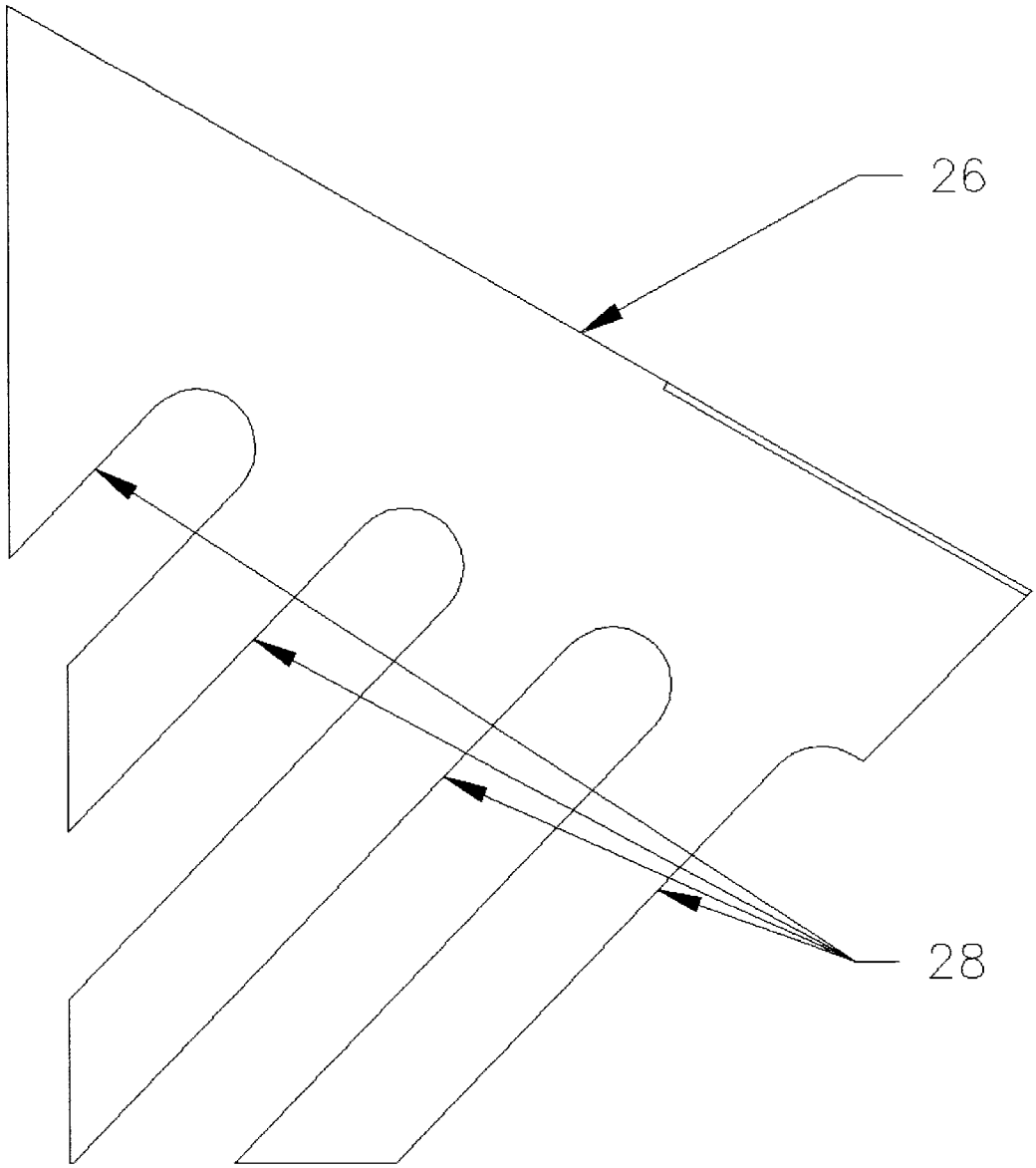
FIG. 5 shows a prospective view of a strut member.

An embodiment of the flowable product discharge activator of the present invention 11 will now be described with reference to FIGS. 1–5. Flowable product 10 is shown in bulk storage within a conventional bulk storage container 12. The major mechanical components of the flowable product discharge activator to be attached to container 12 include: a hopper portion 18, a vibratory motor 22, an internal baffle 24, and strut members 26 to support the internal baffle 24.

The product 10 in bulk storage may be any type of relatively loose dry bulk flowable product. The product 10 may be in the form of grains, powders, granules, flakes, chips, flour, fibers, pellets, or the like that is generally flowable and handled in large volumes. Specific examples of some flowable products include grains, intermediary products made from grains, such as flour, animal and pet feed, and various chemical compositions. Important characteristics of a flowable product 10, in terms of the present invention, are its relative dryness and the tendency of the product 10 to compact together when in or flowing through a storage container 12. The compacting effect should be relatively weak, so that the flowable product 10 is able to again becomes substantially free-flowing upon application of a generally vibratory or agitation action. The product 10 in large volumes may be any amount of flowable product 10 contained within a bulk storage container 12, including volumes of up to thousands of cubic feet of flowable product 10 or more.

The bulk storage container 12 generally is any vessel typically used for the bulk storage of flowable products 10. The storage container 12 may typically be cylindrical, square, rectangular or of any other shape. The bulk storage container 12 is most commonly of a cylindrical shape with a closed top, a cone-shaped hopper bottom, and is usually constructed of steel. The container 12 should be constructed of material strong enough to contain the flowable product 10 and withstand its bulk weight. Although the size of the container 12 is relatively unimportant to the operation of the invention 11, a typical cylindrical container 12 may generally have a major cross-sectional diameter D of about four feet (4') to about twenty-four feet (24'), with about twelve feet (12') being a typical diameter. It should be understood that the invention 11 is suitable for use with containers having a major cross-sectional diameter from about one inch (1") to about sixty feet (60') or more. The container 12 may taper or neck down, so that the minor cross-sectional area A' of the lower opening 17 may be less than, typically about half, the major cross-sectional area A of the container 12. Otherwise, suitable containers of configurations other than cylindrical will generally have equivalent cross-sectional areas and may similarly taper from an upper larger cross-sectional area to a lower smaller cross-sectional area. The height of the container 12 may up to several hundred feet. Suitable containers include bins, dispensers, silos and the like.

The hopper portion 18 may be a cone or pyramid shaped shell, with its apex or minimal cross-sectional end oriented downward. Although a cone or pyramid shape has been found to be suitable, the hopper 18 may be of any other shape that generally tapers from a relatively larger cross-sectional area upper end to a relatively smaller cross-sectional area lower end. The hopper 18 is suitably of a size and shape which accommodates the interior components of the flowable product discharge activator, that is, the internal baffle 24 and the strut members 26 and the product 10 flowing through the hopper 18. The hopper 18 may be constructed of metal, metal-like material, or suitable polymeric material. The material should be of sufficient rigidity and weight to be vibratable by the vibratory motor 22. The material also should have sufficient structural integrity to withstand the weight of the flowable product 10. As with all components in this invention, the material forming the hopper 18 will suitably have a co-efficient of friction when in operation that facilitates efficient product 10 flow through the hopper 18, i.e. quickly, evenly and without damming or compacting.

The hopper portion 18 has an upper entrance opening 19 and a lower exit opening 20. Generally, the entrance opening 19, through which flowable product 10 enters the hopper 18, is elevated with respect to and larger than the lower exit opening 20 through which the product 10 exits the hopper 18. The height differential permits the product 10 to flow through the hopper 18, at least in part, by gravitational force. The larger entrance opening 19 may have a an area essentially equal to or larger than the minor area A' of the bulk storage container 12 to minimize damming around the entrance to the hopper 18. The lower exit opening 20 is generally sized large enough to permit efficient product 10 flow therethrough.

Diameter sizes which have been found to be suitable under actual use circumstances range from about two inches (2") to about forty-eight inches (48"), with the most typical size being perhaps eight inches (8"). Container 12 major diameter can range from one foot (1') to thirty feet (30') in diameter, while the minor diameter can range from one foot (1') to twelve feet (12') in diameter. Hopper 18 major diameter can range from one foot (1') to twelve feet (12') in diameter, while the minor diameter can range from two inches (2") to four feet (4') in diameter. While these distances have been described in terms of diameter, the cross section may be in a shape other than a circle. These proposed measurements may be correlated to other shapes via area calculations.

The hopper 18 may be joined to an outlet spouting 34 which extends from the lower exit opening 20 in communication therewith and generally of an area equal to or larger than the exit opening 20. The outlet spouting 34 can be constructed of virtually any material, including steel, as this is not a necessary component to the invention. It is shown here as a typical mechanism for containing the product as the product is discharged from the bulk storage container 12. The outlet spouting 34 could be eliminated from the discharger 11 although in actual practice it is commonly used. The size of the outlet spouting 34 should be of equal or larger area than the minor diameter or area of the hopper portion 18. To allow for an equal or larger exit shaft opening 20.

The hopper portion 18 is attached to the flanged outlet 14 of the bulk storage container 12 by the inlet flange 16 of the flexible connection 30. The flexible connection 30 contains the product 10 flowing therethrough, and is secured to the inlet flange 16 and to the hopper portion 18 by band clamps 32. The outlet 20 of the hopper portion 18 may be attached to outlet spouting 34 by a flexible connection 36. When outlet spout 34 is used, the flexible connection 36 channels the product 10 flowing therethrough, and is secured to the outlet 20 of the hopper portion 18 and to the outlet spouting 34 by band clamps 38.

The hopper portion 18 is supported by free-swinging, hanging fasteners 40 that work in combination with flexible connections 30 and 36 to allow for limited movement of the hopper portion 18. The flexible connections 30 and 36 may be made of any elastomer that is flexible enough to allow for the limited movement of the hopper portion 18 while being strong enough to contain the product 10. The approximate lengths may range for two inches (2") to ten inches (10") and the thickness may range from approximately one-eighth inch (⅛") to one-half inch (½") thick. The free swinging, hanging fasteners 40 are each, include a threaded rod 42, circular shaped vibration isolation pads 44, flat steel washers 46 and self-locking nuts 48 (See FIG. 4). The flexible connection 30 is not directly attached by the hanging fasteners 40, it is contained by the fasteners 40. The connection 30 is attached or secured by the band clamps 32. A grounding strip may be used to distribute static electricity away from the container 12, hopper 18 and connection 30.

The vibratory motor 22 may be any self-contained vibratory motor, such as a motor with rotating counterweights that is expressly designed for use with vibratory machinery. The vibratory motor is securely fastened to the hopper portion 18. The vibratory motor 22 is a foot-mounted unit that includes an integral mounting base with four (4) bolt holes for attachment. The motor 22 is rigidly bolted to the motor mounting plate 23, that is, a fixed rigid extension off of the hopper portion 18. The action of the vibratory motor 22, when properly applied in combination with the other major components of the described embodiment, sets the flowable product 10 in motion, overcoming the coefficient of friction that is present between the particles of product 10 when the bulk product 10 is in a steady, resting state within the bulk storage container 12. The vibratory motor 22 may be electrical or pneumatically activated. When energized, the motor 22 imparts a vibratory action on the hopper portion 18 to vibrate or agitate the product 10 flowing therethrough. Suitable vibratory motors 22 are commercially available from Martin Engineering, One Martin Place, Neponset, Ill. 61345-9766 under the trademark MOTOMAGNETIC. Such motors 22 typically range in size from 0.5 HP to 10 HP for hopper 18 sizes having major diameters which range generally between about two feet (2') and about fifteen feet (15'). The vibratory motor 22 is joined to the hopper 18 along an external wall thereof on motor mounting plate 23, as can perhaps best be seen with reference to FIGS. 1 and 2, such that, when in operation, the vibratory motor 22 imparts a vibratory action to the hopper 18 and those components in vibratory communication with it. The vibratory motor 22 generally is of sufficient force such that its vibration tends to loosen any compacted flowable product 10 and allows it to flow through the hopper 18. The vibratory motor 22 is operatively connected to the hopper portion 18, so as to impart a rapid, circular motion to the hopper portion 18 and the product 10 flowing therethrough. The motor 22 imparts a circular rotational motion on the hopper portion 18 by adjustable rotating counterweights within the vibratory motor 22. The circular rotational forces generated by the vibratory motor 22 are transferred to the hopper portion 18 through the rigidly bolted connection to the motor mounting plate 23. The combination of the circular rotational forces generated by the vibratory motor 22 and the limited motion allowed by the free swinging, hanging fasteners 40 with the force of gravity, imparts a fluid-like, vortex movement of the product 10 toward exit opening 20.

The internal baffle 24 may be a cone or pyramid shaped structure suspended above the exit opening 20 of the hopper portion 18. The baffle 24 should have sufficient slope and a co-efficient of friction while in operation that the flowable product 10 does not dam-up around the baffle 24. To this end, the apex of the baffle 24 should point directly toward the incoming flow of the product 10, which most commonly is in a direction upward from the apex. The internal baffle 24 shields the flowable product 10 that is near the outlet 20 of the hopper portion 18 from the compacting forces that are present within the bulk storage container 12. The surface of the internal baffle 24 is sloped to direct the downward flow of product 10 towards the outlet 20 of the hopper portion 18 at an angle from horizontal or vertical. Suitable materials for the baffle 24 include metal and plastics. The material should have sufficient strength to withstand the forces from the flowable product 10, while maintaining a desirable co-efficient of friction to ensure efficient product flow through and around the baffle while in operation. The baffle shell 24 has a smaller diameter than the entrance opening 19, and a larger diameter than the exit opening 20. The angle of slope is any angle between approximately five degrees and 85 degrees from horizontal. The center of the baffle shell 24 is positioned approximately on the same vertical centerline as the exit opening 20.

The diameter of lower end of the baffle 24 should be related to the diameter of the exit opening 20 and the flow rate of the product 10 therethrough. The purpose of the baffle 24 is to shield the exit opening 20 from the compacting forces of the product 10 to allow the product 10 that is in close proximity of the exit opening 20 to flow unrestricted from the container. The baffle 24 also transmits the vibratory forces in to the bulk of the product 10 that is in the bulk storage container 12 above, further initiating the uniform downward movement of the product 10. Any damming of product will tend to slow the flow rate, and can lead to other serious problems, including contamination of the product 10 due to non-uniformity of product flow. The baffle 24 helps to uniformly initiate the product flow and avoid problems of damming. The baffle shell 24 is a smaller diameter than the entrance opening 19, and a larger diameter than the exit opening 20. The baffle shell 24 can be a solid, or hollow (open on the bottom), inverted cone shape structure. The baffle shell 24 and the strut supports 26 with the sifting/activating features 28 are made from solid sheet or plate material with the exception of the openings for the sifting/activating features 28.

Strut members 26 support the internal baffle 24, suspending the baffle 24 above the outlet 20 of the hopper portion 18, positioning the baffle 24 far enough above the hopper portion 18 to allow an adequate flow of product 10 to the outlet 20 of the hopper portion 18. Strut members 26 that support the internal baffle 24 include sanitary, product sifting/activating features 28 consisting of openings or perforations that are sized, spaced and shaped in such a way that while in operation, will maximize the differential between the activated to non-activated flowable product 10 near the outlet 20 of the hopper portion 18 while consisting of no horizontal ledges or corners on which the product 10 may hang-up or collect. Strut members 26 and the sifting/activating features 28 may be constructed of a metal or metal-like material. The members 26 are positioned vertically within the hopper portion 18 with respect to the flat surfaces of the sheet or plate material from which they are made. The upper edge of the member 26 is sharpened and slopped so that it easily slices through the downward flowing product 10. (See FIG. 5).

OPERATION

The vibratory motor 22 is activated when it is desired to discharge flowable product 10 from the storage container 12 through the outlet 20 of the hopper portion 18. For most applications, the vibratory motor 22 runs continuously while discharging flowable product 10. In order to conserve energy and to enhance the useful life of the motor and its components, the amplitude of vibration output of the vibratory motor 22 may generally be set at the lowest level required to activate the flowable product 10. Lower vibration amplitude settings on the vibratory motor 22 generally yield higher operational efficiencies in regard to overall energy consumption. The vibration amplitude is set according to criteria of the particular application. The vibration amplitude of the vibratory motor 22 is adjusted by positioning counterweights that are located on opposite ends of the shaft of the vibratory motor 22. Both of the counterweights are set at the same amplitude adjustment which is an increment of percentage of full (100%). The optimum setting is attained at the least amplitude percentage setting that produces the desired rate of product 10 discharge, usually about 20 to 60% of full setting.

Activation of flow of the product 10 can be defined as a high frequency vibration that initiates flow movement of the product 10 by overcoming any static coefficient of friction forces present between particles of the flowable bulk product 10 near the outlet 20 of the hopper portion 18. Together with the absence of horizontal components and the presence of the sifting/agitating features 28, a uniform, mass-flow discharge of flowable product 10 from the bulk storage container 12 is readily accomplished.

Although the present invention has been described with reference to preferred embodiments, workers skilled in the art will recognize changes may be made in form and detail without departing from the spirit and scope of the invention.

That which is claimed is:

1. A product discharge activator comprising:

a hopper portion;

a vibratory motor operatively connected to the hopper portion;

a baffle shell; and non-horizontal strut support members suspending the baffle shell within the hopper portion above the hopper lower end.

2. The device of claim 1 further comprising:

sloping surfaces of the shell to direct a flow of product downward at an angle from horizontal or vertical.

3. The device of claim 1, wherein strut members slice through the downward flow of product.

4. A flowable bulk product discharge activator comprising:

a hopper portion tapering from a larger cross-sectional opening upper end to a smaller cross-sectional opening lower end;

a vibratory motor operatively connected to the hopper portion to effect vibration of the hopper portion and of flowable bulk product flowing therethrough;

a baffle shell tapering from an upper smaller cross-sectional apex to a lower larger cross-sectional opening;

non-horizontal strut support members suspending the baffle shell within the hopper portion above the hopper lower end; and a flexible connection for suspending the hopper portion from a flowable bulk product storage container, in bulk product flowable communication with the container, the connection adapted and designed to allow free-swinging suspension of the hopper portion from the container.

5. An activator according to claim 4, wherein the hopper and the baffle shell area are each cone shaped structures.

6. An activator according to claim 4, wherein the motor is electrical.

7. An activator according to claim 4, wherein the strut members have upper edges honed and tapered to a knife edge.

8. An activator according to claim 4, wherein the flexible connection is connected to a lower end of the container by means of free-swinging hanging fasteners.

9. An activator according to claim 5, wherein the free-swinging, hanging fasteners include circular-shaped, vibration-isolation pads to match the circular motion of the vibratory motor to minimize wear to the pads.

10. An activator according to claim 4, wherein the strut members further include sifting and activating features having upper edges honed and tapered to a knife edge.

11. A method of discharging a flowable bulk product comprising:

condensing a cross-sectional area of the product as it flows from an upper inlet to a lower outlet of a hopper portion;

flowing the product over and around a baffle shell suspended above the lower outlet;

vibrating and agitating the condensing flowing product;

flowing the product over and around non-horizontal strut support members which suspend the baffle shell above the lower outlet; and discharging the product in a relatively uniform, mass-flow discharge.

12. A method according to claim 11, wherein the support members slice through the flowing product with upper edges honed and tapered to a knife edge.

13. A method according to claim 12, wherein the support members further comprise sifting and activating means for slicing through the flowing product in a horizontal fashion.

14. A method according to claim 11, and further comprising:

receiving the flowing product through a flexible connection, the connection suspending the hopper portion from a flowable bulk product storage container for limited free-swinging motion.

15. A method according to claim 11, wherein the baffle shell tapers from an upper smaller cross-sectional apex to a lower larger cross-sectional opening.

16. A method according to claim 11, further comprising the step of using vibration isolation pads to minimize friction.

* * * * *